US006672087B1

(12) United States Patent
Taras et al.

(10) Patent No.: US 6,672,087 B1
(45) Date of Patent: Jan. 6, 2004

(54) HUMIDITY AND TEMPERATURE CONTROL IN VAPOR COMPRESSION SYSTEM

(75) Inventors: Michael F. Taras, Fayetteville, NY (US); Thomas J. Dobmeier, Phoenix, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/285,793

(22) Filed: Oct. 30, 2002

(51) Int. Cl.[7] ..... F25D 17/06; F25D 29/00
(52) U.S. Cl. ..... 62/173; 62/90
(58) Field of Search ..... 62/173, 90, 196.4, 62/198, 222; 236/446

(56) References Cited

U.S. PATENT DOCUMENTS 2,770,100 A * 11/1956 Raney ..... 62/4
3,203,196 A * 8/1965 Malkoff ..... 62/173
3,316,730 A * 5/1967 Lauer ..... 62/173
5,477,700 A * 12/1995 Iio ..... 62/231
5,598,887 A * 2/1997 Ikeda et al. ..... 165/202
5,651,258 A * 7/1997 Harris ..... 62/90
5,706,664 A * 1/1998 Hara ..... 62/159
6,055,818 A * 5/2000 Valle et al. ..... 62/173

* cited by examiner

*Primary Examiner*—Marc Norman
(74) *Attorney, Agent, or Firm*—Bachman & LaPointe

(57) ABSTRACT

A vapor compression system including a vapor compression circuit having a compressor, a condenser, an expansion device and an evaporator serially connected by refrigerant lines; an air flow path through the evaporator for generating a cooled air stream; a heat exchanger communicated with the cooled air stream and an air reheating medium which is at least one of refrigerant liquid discharge from the condenser and refrigerant gas discharge from the compressor; and a regulating valve for controlling flow rate of the air reheating medium to the heat exchanger. This scheme provides precise and smooth simultaneous temperature and humidity control as well as reduces a number of start/stop cycles and eliminates switching between cooling and dehumidification regimes of operation, which enhances system reliability.

8 Claims, 1 Drawing Sheet

HUMIDITY AND TEMPERATURE CONTROL IN VAPOR COMPRESSION SYSTEM

BACKGROUND OF THE INVENTION

The invention relates to vapor compression systems and, more particularly, to provision of both humidity and temperature control in same.

Vapor compression systems are utilized in various refrigerant and cooling applications. In such applications, humidity and temperature control are both desirable.

Conventional systems require selection between cooling and dehumidification modes, and do not provide effective means for both functions. Further, when conventional systems are operated to dehumidify an air stream, the air stream must be cooled to a temperature which will not be the optimal or desired temperature at most operating conditions.

It is clear that the need remains for a vapor compression system wherein humidity control and temperature control is both provided.

It is therefore the primary object of the present invention to provide a system wherein humidity and temperature control can be simultaneously achieved.

It is a further object of the present invention to provide such a system wherein the equipment for operating same is simple, cost-effective and reliable.

Other objects and advantages of the present invention will appear hereinbelow.

SUMMARY OF THE INVENTION

In accordance with the present invention, the foregoing objects and advantages have been readily attained.

According to the invention, a vapor compression system is provided which comprises a vapor compression circuit comprising a compressor, a condenser, an expansion device and an evaporator serially connected by refrigerant lines; an air flow path through said evaporator for generating a cooled air stream; a heat exchanger communicated with said cooled air stream and an air reheating medium comprising at least one of liquid discharge from said condenser and refrigerant gas discharge from said compressor; and a regulating valve for controlling flow rate of said air reheating medium to said heat exchanger.

In further accordance with the present invention, a method is provided for operating a vapor compression system, which method comprises the steps of providing a vapor compression circuit comprising a compressor, a condenser, an expansion device and an evaporator serially connected by refrigerant lines; an air flow path through said evaporator for generating a cooled air stream; a heat exchanger communicated with said cooled air stream and an air reheating medium comprising at least one of refrigerant liquid discharge from said condenser and refrigerant gas discharge from said compressor; and a regulating valve for controlling flow rate of said air reheating medium to said heat exchanger; operating said evaporator so as to provide said cooled air stream with a desired humidity; and operating said heat exchanger so as to reheat said cooled air stream to a desired temperature.

The regulating valve is preferably a 3-way regulating valve.

BRIEF DESCRIPTION OF DRAWINGS

A detailed description of preferred embodiments of the present invention follows, with reference to the attached drawings, wherein.

DETAILED DESCRIPTION

The invention relates to a vapor compression system and, more particularly, to a vapor compression system which provides for simultaneous precise humidity and temperature control. In accordance with the present invention, control of both humidity and temperature are provided in a vapor compression system by providing control of humidity through the fine-tuning of operating parameters for the evaporator, and further by providing control of temperature through the adjustment of operating characteristics for an air-reheat heat exchanger.

This scheme provides precise and smooth simultaneous temperature and humidity control as well as reduces a number of start/stop cycles and eliminates switching between cooling and dehumidification regimes of operation, which enhances system reliability.

Figure 1:
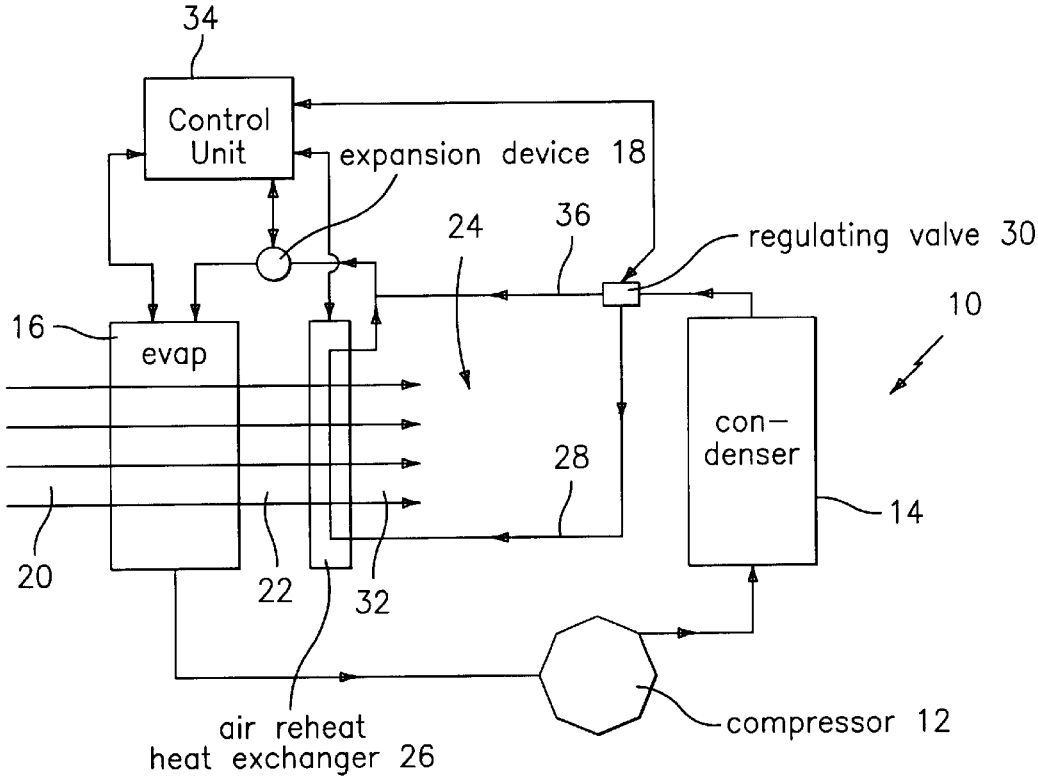
FIG. 1 schematically illustrates a vapor compression system in accordance with the present invention.

FIG. 1 shows an embodiment of the present invention, and shows a vapor compression system 10 including a vapor compression circuit having a compressor 12, a condenser 14, and an evaporator 16, which are serially connected by refrigerant lines. An expansion device 18 is provided upstream of evaporator 16. Refrigerant flows through the vapor compression circuit from compressor 12 to condenser 14, from condenser 14 to expansion device 18, from expansion device 18 to evaporator 16, and from evaporator 16 back to compressor 12.

In accordance with the invention, evaporator 16 serves to cool a stream 20 of incoming air to a desired temperature. In accordance with the present invention, operation of evaporator 16 can be controlled so as to provide for control of humidity of the cooled air stream 22 exiting evaporator 16. This can be accomplished by directly manipulating the temperature/pressure of refrigerant entering evaporator 16 from expansion device 18 for instance by controlling the number of active circuits or by integrating an electronically controlled expansion device as well as through control of the volume of air 20 fed to evaporator 16. By cooling air in evaporator 16 to a particular temperature, moisture removal to a desired extent can be accomplished. Unfortunately, this may require over-cooling the air to an over-cooled temperature which is not the desired final temperature. This problem is solved in accordance with the present invention by provision of an air reheat circuit 24 and an air reheat heat exchanger 26. Air reheat circuit 24 includes air reheat refrigerant lines 28 for conveying an air reheat medium, in this embodiment refrigerant liquid discharge from condenser 14, to air reheat heat exchanger 26. The amount of refrigerant fed to the air reheat circuit 24 is controlled by a regulating valve 30, preferably a 3-way regulating valve which, in accordance with the present invention, advantageously serves to provide for control of the amount of refrigerant fed to air reheat heat exchanger 26. This advantageously provides for control of the final temperature to which cooled air stream 22 is reheated such that a final air stream 32 is provided at a desired temperature.

Thus, in the embodiment of FIG. 1, cooled air stream 22 is fed through heat exchanger 26 and exposed to air reheating medium, in this case liquid refrigerant discharge from condenser 14, for reheating the air stream to the desired temperature. Refrigerant fed through air reheat refrigerant lines 28 to heat exchanger 26 is then returned to the main refrigerant lines and fed to expansion device 18 as desired.

In further accordance with the present invention, a control unit 34 may advantageously be provided and operatively associated with both evaporator 16, heat exchanger 26 and 3-way regulating valve 30, and control unit 34 is adapted to receive instructions from a user as to a desired humidity and temperature of final air stream 32. Control unit 34 then processes the input desired humidity and temperature levels from the user and provides controls to evaporator 16 for controlling the temperature to which air stream 20 is cooled, thereby controlling moisture removal and the humidity of the air stream exiting evaporator 16. In addition, control unit 34 is further adapted to control 3-way regulating valve 30 and/or heat exchanger 26 so as to reheat cooled air stream 22 from the temperature desired to accomplish the selected humidity to the desired temperature. In most cases, the temperature needed to accomplish the desired humidity will be cooler than the desired temperature, and thus, some portion of flow of reheat medium to heat exchanger 26 will be needed. Of course, should the temperature of cooled air stream 22 coincide with that desired by the end user, then heat exchanger 26 does not need to reheat the air stream, and no reheat medium needs to be conveyed to heat exchanger 26. Under these circumstances, control unit 34 would control regulating valve 30 as desired so as to direct all flow through the refrigerant lines to expansion device 18 and evaporator 16.

It should also be appreciated that in embodiments wherein expansion device 18 is an electronically controllable expansion device, control unit 34 may further be operatively associated with expansion device 18 as well so as to control the pressure/temperature of refrigerant entering evaporator 16 as desired.

3-way regulating valve 30 may advantageously be any suitable structure which allows for selectable control of the amount of flow between main refrigerant line 36 and air reheating refrigerant lines 28 including, for instance, a combination of two regulating valves.

In accordance with another aspect of the present invention, the regulating valve may be provided having a plurality of discrete positions corresponding to different ratios of flow between the vapor compression circuit and the air reheat heat exchanger. Further, the control member as discussed above may further be operatively associated with the regulating valve so as to selectively position the valve at one of the plurality of discrete positions.

It should readily be appreciated that the temperature and humidity control system as illustrated in the embodiment of FIG. 1 can readily be incorporated into existing vapor compression systems and/or can be readily designed into systems under manufacture as well. Furthermore this system advantageously provides for selection of desired humidity and temperature levels by a user, and production of a final air stream which corresponds to both these desired parameters. Thus, the vapor compression system in accordance with the present invention advantageously provides for more user friendly function of the system in terms of meeting the needs of the user.

It should be understood that in some circumstances control of evaporator 16 may not be required, and desired humidity and temperature levels can be achieved by controlling flow using a 3-way regulating valve as discussed above.

Figure 2:
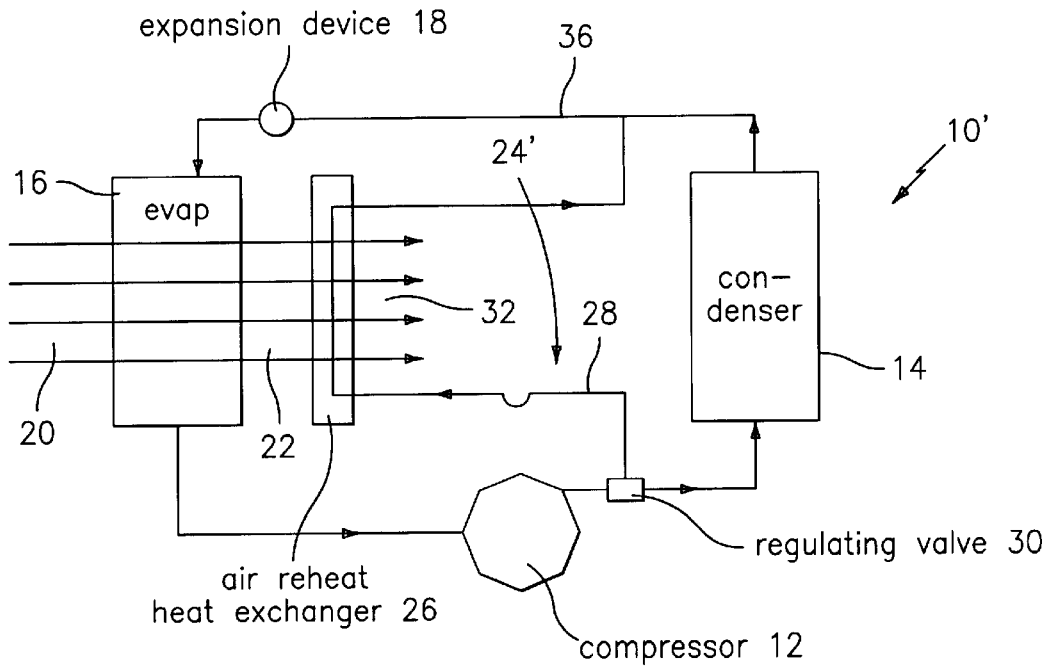
FIG. 2 schematically illustrates an alternative embodiment of a vapor compression system in accordance with the present invention.

FIG. 2 illustrates an alternative embodiment of the present invention, and shows a vapor compression system 10' including a compressor 12, condenser 14, evaporator 16 and expansion device 18 which are communicated by main refrigerant lines 36 such that refrigerant flows from compressor 12 to condenser 14, from condenser 14 to expansion device 18, from expansion device 18 to evaporator 16, and from evaporator 16 back to compressor 12. In further accordance with the invention, and as illustrated in FIG. 1 as well, an air stream 20 is fed to evaporator 16 so as to provide a cooled air stream 22. In this embodiment of the present invention, an air reheat circuit 24' is also provided. However, in this embodiment, air reheat circuit 24' includes an air reheat refrigerant line 28 connected downstream of compressor 12 and upstream of condenser 14 for conveying refrigerant gas discharged from compressor 12 to heat exchanger 26 and back to main refrigerant lines 36 so as to reheat cooled air stream 22 to a temperature as desired in final air stream 32. This embodiment differs from that of FIG. 1 in that air reheat circuit 24' conveys refrigerant gas discharged from compressor 12 through 3-way regulating valve 30 to heat exchanger 26, rather than conveying liquid discharged from condenser 14 as in the embodiment of FIG. 1.

A control unit may advantageously be incorporated into the system of FIG. 2 as well, and could advantageously be adapted to provide for selectable control of evaporator 16, heat exchanger 26 and 3-way regulating valve 30, preferably so as to allow selection of desired humidity and temperature levels of final air stream 32, and conveyance of instructions to evaporator 16 and 3-way regulating valve 30 such that these components are operated to provide the desired humidity and temperature.

It should readily be appreciated that the provision of regulating valve 30 for controlling flow through the air reheat circuit, as well as the control unit controlling operation of evaporator 16 and regulating valve 30, advantageously provide for selective control of both humidity and temperature, thereby satisfying the needs of a user of the vapor compression system in accordance with the present invention.

It should also be appreciated that the scheme of the present invention allows for smooth temperature and humidity control rather than abrupt changes typical of conventional systems.

Furthermore, the system of the present invention allows for reduction of start/stop switching between cooling and dehumidification cycles, thus improving system reliability.

It is to be understood that the invention is not limited to the illustrations described and shown herein, which are deemed to be merely illustrative of the best modes of carrying out the invention, and which are susceptible of modification of form size, arrangement of parts and details of operation. The invention rather is intended to encompass all such modifications which are within its spirit and scope as defined by the claims.

What is claimed is:

1. A vapor compression system, comprising:

a vapor compression circuit comprising a compressor, a condenser, an expansion device and an evaporator serially connected by refrigerant lines;

an air flow path through said evaporator for generating a cooled air stream;

a heat exchanger communicated with said cooled air stream and an air reheating medium comprising at least one of refrigerant liquid discharge from said condenser and refrigerant gas discharge from said compressor;

a regulating valve for controlling flow rate of said air reheating medium to said heat exchanger; and a control member communicated with said expansion device for controlling refrigerant flow to said evaporator, and communicated with said regulating valve for controlling flow rate of said air reheat medium to said heat exchanger, whereby simultaneous control of temperature and humidity of said cooled air stream can be provided.

2. The system of claim 1, wherein said regulating valve comprises a regulating valve positioned along said refrigerant lines for splitting refrigerant flow between said vapor compression circuit and said heat exchanger.

3. The system of claim 2, wherein said regulating valve is adapted to allow a plurality of different ratios of splitting of said refrigerant flow between said vapor compression circuit and said heat exchanger.

4. The system of claim 3, wherein said valve has a plurality of discrete positions corresponding to said plurality of different ratios.

5. The system of claim 4, wherein said control member is communicated with said regulating valve for selectively positioning said valve in one of said plurality of discrete controlled positions.

6. A method for operating a vapor compression system, comprising the steps of:

providing a vapor compression circuit comprising a compressor, a condenser, an expansion device and an evaporator serially connected by refrigerant lines; an air flow path through said evaporator for generating a cooled air stream; a heat exchanger communicated with said cooled air stream and an air reheating medium comprising at least one of refrigerant liquid discharge from said condenser and refrigerant gas discharge from said compressor; and a regulating valve for controlling flow rate of said air reheating medium to said heat exchanger;

operating said expansion device and said evaporator so as to provide said cooled air stream with a desired humidity; and operating said heat exchanger so as to reheat said cooled air stream to a desired temperature.

7. The method of claim 6, wherein said step of operating said expansion device and said evaporator comprises operating said expansion device to control at least one of pressure and temperature of refrigerant entering said evaporator so at to provide said cooled air stream having said desired humidity and an over-cooled temperature lower than said desired temperature.

8. The method of claim 7, wherein said step of operating said heat exchanger comprises feeding said air reheating medium to said heat exchanger at a temperature and flow rate sufficient to heat said cooled air stream from said over-cooled temperature to said desired temperature.

* * * * *